US005437613A

United States Patent [19]

Reggio et al.

[11] Patent Number: 5,437,613

[45] Date of Patent: Aug. 1, 1995

[54] NECK BRACE

[76] Inventors: David Reggio, 4810 Longfellow; Donald Riley, 4819 Longfellow, both of New Orleans, La. 70127

[21] Appl. No.: 110,520

[22] Filed: Aug. 23, 1993

[51] Int. Cl.[6] ..... A61F 5/00

[52] U.S. Cl. ..... 602/18; 2/425; 24/596

[58] Field of Search ..... 602/17–19, 602/4; 128/DIG. 23; 2/422, 425, 2; 482/91, 105; 24/663, 596, 597, 591, 590

[56] References Cited

U.S. PATENT DOCUMENTS

| | | | |
|---|---|---|---|
| 653,397 | 7/1900 | Pettijohn | 24/597 X |
| 2,835,249 | 5/1958 | Brandano | 128/882 |
| 3,148,375 | 9/1964 | Jones | 2/425 X |
| 3,671,974 | 6/1972 | Sims | 2/425 X |
| 3,706,310 | 12/1972 | Garnett | 602/4 |
| 3,818,509 | 6/1974 | Romo et al. | 2/425 X |
| 5,123,408 | 6/1992 | Gaines | 602/17 |
| 5,261,125 | 11/1993 | Cartwright et al. | 602/17 X |
| 5,272,770 | 12/1993 | Allen et al. | 2/2 |

*Primary Examiner*—Linda C. M. Dvorak
*Attorney, Agent, or Firm*—Keaty & Keaty

[57] ABSTRACT

The invention relates to a neck brace for protecting the user during vigorous activities. The neck brace has an elongated non-stretchable, flexible strap carrying a T-shaped pin on one end thereof. An eye bracket is fixedly attached to a helmet of the user, the opening in the bracket allowing to engage the pin of the strap therein. The second end of the strap is secured to the body harness of the user and, the strap is stretched tight to prevent dislocation of the users muscles and neck bones during the activities. As a result, the user can bend his head slightly downward but not so much as to force his head down on to his chest.

4 Claims, 1 Drawing Sheet

NECK BRACE

BACKGROUND OF THE INVENTION

The present invention relates to a device for protecting a neck of a user against violent shocks which may lead to a neck injury, or help to prevent injury to the spinal cord.

More specifically, the present invention relates to an adjustable strap attachable to the helmet of the user and to a body-protecting gear conventionally worn by sportsmen and others.

In many sports and high impact activities, the user wears a helmet to protect against head injuries, as well as protective padding for the torso. However, in most instances the neck remains unprotected and is subject to considerable shock when a sportsman tries to intercept another player head-on. The shock can cause a serious injury, such as sprain of the neck muscle, or even fracture and dislocation of the neck bones or the spinal cord. Various devices have been proposed for protecting the user's neck by limiting movement of the neck through positioning some type of restraint between the helmet and a body protective gear.

One of such devices is disclosed in U.S. Pat. No. 3,818,509 issued on Jun. 25, 1974 to Romo, et al entitled "Apparatus For Preventing Neck Injury." In accordance with that patent, an elastic strap for preventing neck injuries is used in combination with a head piece and body harness, that is secured to the helmet and the harness by snaps. However, during a vigorous activity the snap engagement may prove insufficient, since the snaps can become disengaged from the helmet or from the body harness, thereby defeating the purpose of the device.

Another example of attempted solutions to the problem is disclosed in U.S. Pat. No. 3,873,996 issued on Apr. 1, 1975 to Varteressian for "Articulated Head and Neck Protector Apparatus", in accordance with which the forward and backward movements of the head are limited by a rigid control arm, one end of which moves in the track attached to the helmet, and the second end of which carries a ball received in a socket supported by the user's jacket. While such arrangement may be beneficial in limited environments, it will considerably impede movements of the sportsman who has to rotate and tilt his head during a game and not be limited by the rigid constraints of the socket.

The present invention contemplates to eliminate drawbacks associated with the prior art and provide an improved neck brace for limiting movement of the user's neck and thereby prevent strain or fracture of the neck.

SUMMARY OF THE INVENTION

It is, therefore, an object of the present invention to provide a neck brace for preventing neck injury of the user.

It is another object of the present invention to provide a device which is easy to use and inexpensive to manufacture.

It is a further object of the present invention to provide a neck brace device which limits movement of the user's neck, while permitting the user to move his head to a degree necessary to perform the required actions, while protecting the neck from injury.

These and other objects of the present invention are achieved through a provision of a flexible, bendable, non-stretchable elongated strap having a T-shaped securing pin secured at one of its ends, and a ring-buckle on its opposite end.

An eye bracket is fixedly attached to a helmet of a user, the bracket being adapted to receive the pin in a corresponding opening thereof. A spring plate is secured to an inner side of the bracket to prevent the pin from disengaging from the bracket. A user secures one end of the strap to the bracket and the second end to a body harness and then adjusts the length of the strap to stretch tight between a helmet and shoulder pads of a body harness. Preferably it is adjusted so the head cannot be pushed down (toward the chest) too far, so as not to injure the spinal cord.

BRIEF DESCRIPTION OF THE DRAWINGS

Reference will now be made to the drawings, wherein like parts are designated by like numerals, and wherein.

DETAILED DESCRIPTION OF THE PREFERRED EMBODIMENT

Figure 4:
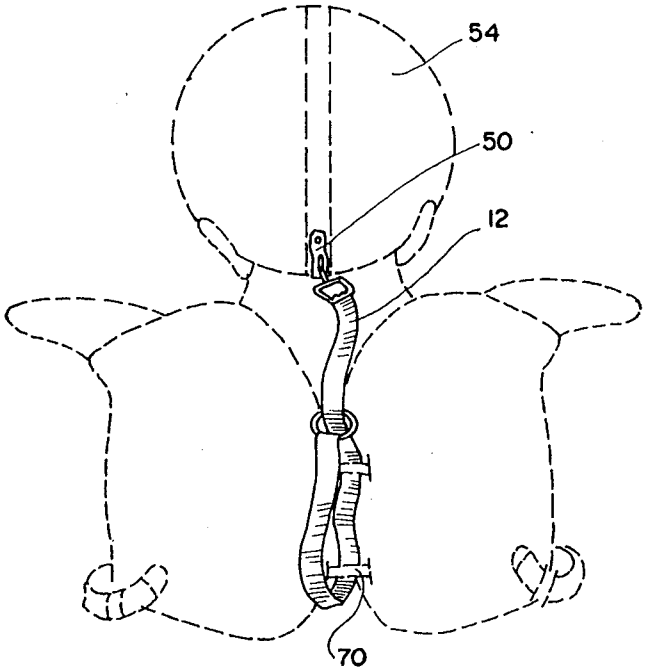
FIG. 4 is a perspective view showing the use of the neck brace in relation to a helmet and back harness of a football player.

Referring now to the drawings in more detail, the device of the present invention is generally designated by numeral 10. The neck brace 10 comprises an elongated flexible, bendable, non-stretchable strap 12 having a first end and a second end 16. Secured on the first end 14 is an adjusting buckle 20 through which the end 14 is threaded. The buckle 20 is comprised of a substantially rectangular frame 22 having a cross piece 24 which carries a T-shaped pin 30. The pin 30 has a horizontal portion 32 and a vertical portion 34 integrally formed together and attached to the cross piece 24 at the base of the vertical portion 34. A discrete length of strap 36 extends through the buckle 20 on the opposite side of the strap main body 38 and can be pulled through the buckle 20 to adjust the length of the strap, as will be described below hereinafter. The cross piece 24 pivots, to some degree, in the direction of arrow 25, about the side 23 of the frame 22.

The opposite end 16 of the strap 12 carries a securing buckle, or ring 40 which can be a ring attached to the end 16 by folding the outermost edge of the end 16, over the body of the ring 40 and stitching (as at 82) the folded over piece to the main body 38 adjacent the end 16. The outermost edge can also be riveted (as at 84) to the end 16, or both stitched and riveted.

In order to secure the device 10 to a helmet of the user, a bracket means 50 is fixedly attached, such as by bolt 52 to the back of the helmet 54 a distance from the lowermost edge 56 of the helmet. The bolt 52 passes through an opening formed in the upper part of the bracket 50 and threadably engages with a T-nut 70 by fitting within a portion 72 of the T-nut. To make the engagement, the bolt 52 and the portion 72 are provided with matching threads. The portion 72 extends through an opening 74 made in the helmet 54 (see FIG. 2), while a portion 76 of the T-nut 70 remains on the inside of the helmet 54.

Figure 2:
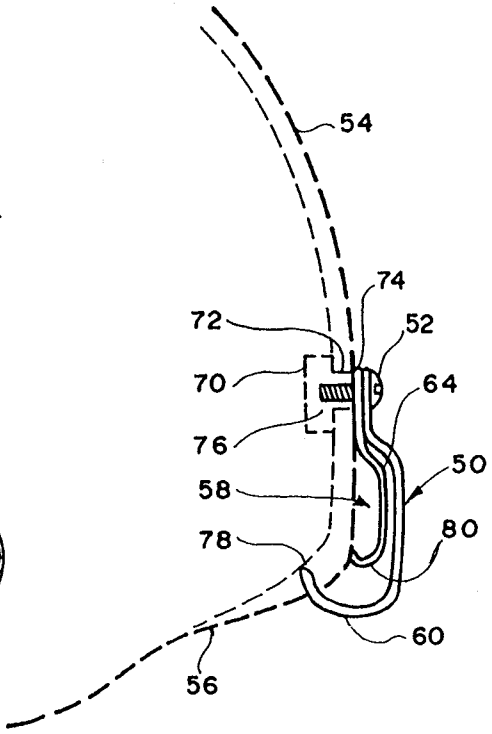
FIG. 2 is a detail side view of the bracket attached to the back of the helmet.
Figure 1:
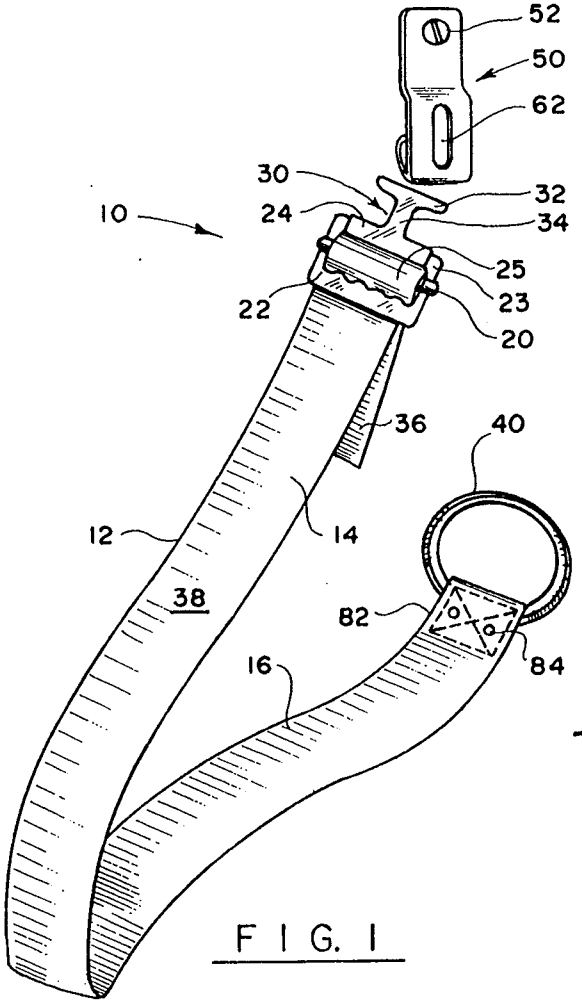
FIG. 1 is a perspective view of the neck brace device in accordance with the present invention.

The bracket 50, as can be better seen in FIG. 2, is generally hook-shaped, with the lower part 60 bent away from the upper part, so that a space 58 is formed between the exterior surface of the helmet 54 and the part 60 of the bracket 50. The lower part 60 fits under the edge 56 of the helmet 54, so that it cannot be pulled away from the helmet 54. Even though the end 78 is positioned inside the helmet 54, it will not inconvenience the user, since it is bent preferably flush with the inner surface of the helmet.

An elongated opening 62 (FIG. 3) is formed in the portion 60, the opening being wide and long enough to allow the horizontal portion 32 of the pin 30 to pass therethrough lengthwise. Once the pin 30 passes through the "eye", or opening 62 of the bracket 50, it is turned 90 degrees, so that it is placed horizontally in relation to the bracket 50, and cannot be easily withdrawn from the opening 62.

Figure 3:
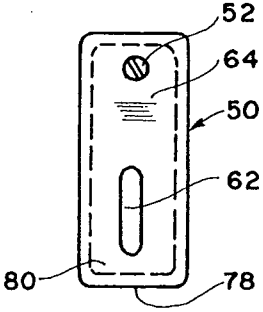
FIG. 3 is a front view of the bracket, with the spring plate shown in phantom lines.

In order to prevent accidental disengagement of the pin 30 from the bracket 50, a spring means 64 is fitted in the space 58, between the bracket 50 and the exterior of the helmet 54. The spring means 64 can be formed as a thin metal plate, for example a spring steel plate, which is attached to the helmet 54 in a manner similar to the attachment of the bracket 50 by forming a corresponding opening in the upper portion of the spring plate 64 through which the bolt 52 passes. Similarly to the portion 60 of the bracket 50, the spring plate 64 is bent to generally follow the shape of the bracket and is long enough to at least partially cover the opening 62. Preferably, the spring plate 64 covers entire opening 62, as can be seen in FIGS. 2 and 3.

The spring plate 64 is pushed away from the portion 60 of the bracket 50 when the pin 30 is manually forced through the opening 62. However, once the portion 32 is rotated 90 degrees, the spring 64 returns to its original position in close proximity to the portion 60 and blocks the opening 62 to a degree sufficient to prevent withdrawal of the pin 30 during use of the device. The lower end 80 of the plate 64 can push against the pin 30, preventing its withdrawal.

When it is necessary to disengage the pin 30 from the bracket 50, the spring 64 can be forced upwardly and away from the bracket 50 by the portion 32 of the pin 30 to allow withdrawal of the portion 32 from the opening 62.

In operation, the end 16 of the strap 12 is wrapped around a harness 70 (see FIG. 4) and is pulled tight, leaving almost no slack in the length of the strap 12. The length of the strap 12 can then be adjusted by pulling on the end 36, forcing the extra length of the strap through the buckle 20 to keep the strap 12 in a relatively tight position between the bracket 50 and the harness 70. The user then engages the pin 30 within the bracket 50 which has been previously secured to the helmet 54. Further adjustment in the length of the strap 12 is made to allow the user to only slightly bend his head forward, towards his chest. As a result, the movement of the neck is considerably reduced, such that the user cannot freely move the head forward, with the non-stretchable strap 12 preventing bending of the head to any substantial degree. At the same time, sideways motions of the head, tilting and rotation are not substantially limited, allowing the user to perform his vigorous activities, while at the same time protecting the neck muscles, bones and spinal cord.

It is envisioned that the strap 12 can be made from non-stretchable fabric, such as for example nylon, with bracket 50, spring plate 64 and buckle 20 made from a strong material, such as hard plastic or metal. Similarly, a securing buckle 40 can be made from metal or plastic, if desired.

Many changes and modifications can be made within the design of the present invention without departing from the spirit thereof. I, therefore, pray that my rights to the present invention be limited only by the scope of the appended claims.

I claim:

1. A neck brace device, comprising:

an elongated flexible non-stretchable strap having a first end and a second end;

means for securing the first end of the strap on a headgear of a user, said securing means comprising a hook-shaped bracket having an upper end adapted for a fixed attachment to headgear of the user and a hook-shaped lower end which extends downwardly from said upper end and is adapted to fit under a lowermost edge of the headgear, so as to prevent the bracket from being pulled away from the headgear, said bracket being provided with an elongated narrow opening, said securing means further comprising a buckle which is secured to the first end of the strap, said buckle having a T-shaped pin which engages the bracket by being fitted through said opening;

means for preventing disengagement of the pin from said bracket, said means comprising a spring plate having an upper portion which is adapted for engagement to said upper end of the bracket and the headgear of the user and a hook-shaped lower portion which extends downwardly a distance away from said lower end of the bracket to cover substantially the entire opening of said bracket and thereby prevent accidental disengagement of the pin from the bracket; and means for securing the second end of the strap to a body harness of the user.

2. The device of claim 1, wherein said means for securing the second end comprises a securing buckle affixed to the second end and allowing to form a tight loop of the strap about at least a part of the body harness.

3. A neck brace device, comprising:

an elongated flexible, non-stretchable strap having a first end and a second end, said strap being long enough to at least stretch between a head gear of the user and a body harness of the user;

a means for securing the first end of the strap on a headgear of the user, said means comprising a hook-shaped bracket fixedly attachable to headgear of the user, said bracket having a hook-shaped lower end which extends downwardly and is adapted to fit under a lowermost edge of the headgear, so as to prevent the bracket from being pulled away from the headgear, said bracket having an elongated opening formed in one end thereof, said means for securing further comprising a buckle secured to the first end of the strap, said buckle carrying a T-shaped pin having a horizontal part and a vertical part, said pin adapted for engagement with the bracket through fitting the horizontal part of the pin through the opening formed in the bracket;

means for preventing disengagement of the pin from the bracket; and means for securing the second end of the strap to a body harness of the user, said means comprising a securing buckle affixed to the second end and allowing to form a tight loop of the strap about at least a part of the body harness.

4. The device of claim 3, wherein said means for preventing disengagement of the pin comprises a plate spring means adapted to be secured to the headgear and adapted to extend between an exterior surface of the headgear and an inner surface of the bracket, said plate spring means covering substantially the entire opening of said bracket after the pin has been engaged with the bracket.

* * * * *